US011538411B2

(12) United States Patent
Hong et al.

(10) Patent No.: US 11,538,411 B2
(45) Date of Patent: Dec. 27, 2022

(54) DISPLAY DEVICE AND METHOD FOR DRIVING DISPLAY DEVICE

(71) Applicant: LG DISPLAY CO., LTD., Seoul (KR)

(72) Inventors: MooKyoung Hong, Paju-si (KR); KwangMo Park, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/539,864

(22) Filed: Dec. 1, 2021

(65) Prior Publication Data

US 2022/0189356 A1 Jun. 16, 2022

(30) Foreign Application Priority Data

Dec. 10, 2020 (KR) ..... 10-2020-0172566

(51) Int. Cl.

| | |
|---|---|
| ***G09G 3/3233*** | (2016.01) |
| ***G09G 3/3208*** | (2016.01) |
| ***G09G 3/3275*** | (2016.01) |
| ***G09G 3/32*** | (2016.01) |

(52) U.S. Cl.

CPC ..... *G09G 3/3233* (2013.01); *G09G 3/3208* (2013.01); *G09G 3/3275* (2013.01); *G09G 3/32* (2013.01); *G09G 2320/0295* (2013.01); *G09G 2320/043* (2013.01); *G09G 2320/045* (2013.01)

(58) Field of Classification Search

CPC .. G09G 3/3233; G09G 3/3208; G09G 3/3275; G09G 3/32; G09G 2320/0295; G09G 2320/043; G09G 2320/045; G09G 2300/0842

See application file for complete search history.

(56) References Cited

U.S. PATENT DOCUMENTS

| | | | | |
|---|---|---|---|---|
| 8,373,628 | B2 * | 2/2013 | Fish | G09G 3/3233 345/82 |
| 8,970,577 | B2 * | 3/2015 | Lillie | G06F 3/041 345/214 |
| 9,685,114 | B2 * | 6/2017 | Chaji | G09G 3/3266 |
| 9,697,771 | B2 * | 7/2017 | Azizi | G09G 3/3696 |
| 9,824,632 | B2 * | 11/2017 | Chaji | H05B 47/10 |
| 10,460,666 | B2 * | 10/2019 | Kim | G09G 3/3266 |
| 10,657,895 | B2 * | 5/2020 | Chaji | G09G 3/006 |
| 10,665,174 | B2 * | 5/2020 | Park | G09G 3/3291 |
| 10,699,644 | B2 * | 6/2020 | Kim | G09G 3/3258 |
| 10,720,110 | B2 * | 7/2020 | Jung | G09G 3/3233 |
| 10,818,236 | B2 * | 10/2020 | Gai | G09G 3/3233 |
| 10,818,237 | B2 * | 10/2020 | Noh | G09G 3/3258 |
| 11,238,796 | B2 * | 2/2022 | Han | G09G 3/3258 |
| 11,250,747 | B2 * | 2/2022 | Park | G09G 3/3233 |
| 11,263,979 | B2 * | 3/2022 | Yang | G09G 3/3266 |
| 11,308,877 | B2 * | 4/2022 | Lee | G09G 3/3233 |
| 11,398,191 | B2 * | 7/2022 | Kim | G09G 3/3291 |
| 2007/0236430 | A1 * | 10/2007 | Fish | G09G 3/3233 345/82 |

(Continued)

*Primary Examiner* — Michael J Jansen, II

(74) *Attorney, Agent, or Firm* — Birch Stewart, Kolasch & Birch, LLP

(57) ABSTRACT

A display device and a method for driving the display device are discussed, which can save costs and implement high luminance by adopting a voltage sensing scheme for accurately sensing characteristic values of the light emitting device in the subpixel for compensation while also increasing the available display area.

20 Claims, 12 Drawing Sheets

(56) References Cited

U.S. PATENT DOCUMENTS

| | | | | |
|---|---|---|---|---|
| 2014/0267217 | A1* | 9/2014 | Lillie | G06F 3/041 345/214 |
| 2016/0163262 | A1* | 6/2016 | Azizi | G09G 3/3696 345/212 |
| 2016/0225316 | A1* | 8/2016 | Chaji | G09G 3/3266 |
| 2016/0329017 | A1* | 11/2016 | Chaji | H05B 47/10 |
| 2018/0068611 | A1* | 3/2018 | Chaji | G09G 3/3233 |
| 2018/0151129 | A1* | 5/2018 | Park | G09G 3/3291 |
| 2018/0182303 | A1* | 6/2018 | Jung | G09G 3/3233 |
| 2018/0190198 | A1* | 7/2018 | Kim | G09G 3/3233 |
| 2019/0189056 | A1* | 6/2019 | Gai | G09G 3/3233 |
| 2019/0197959 | A1* | 6/2019 | Noh | G09G 3/3266 |
| 2020/0013340 | A1* | 1/2020 | Kim | G09G 3/3233 |
| 2020/0074939 | A1* | 3/2020 | Kim | G09G 3/3291 |
| 2020/0388218 | A1* | 12/2020 | Han | G09G 3/3233 |
| 2021/0104185 | A1* | 4/2021 | Park | G09G 3/3266 |
| 2021/0150981 | A1* | 5/2021 | Lee | G09G 3/3233 |
| 2021/0335279 | A1* | 10/2021 | Yang | G09G 3/3275 |
| 2022/0020334 | A1* | 1/2022 | Kim | G09G 3/3233 |
| 2022/0189356 | A1* | 6/2022 | Hong | G09G 3/3275 |
| 2022/0208095 | A1* | 6/2022 | Kim | G09G 3/3275 |

* cited by examiner

DISPLAY DEVICE AND METHOD FOR DRIVING DISPLAY DEVICE

CROSS-REFERENCE TO RELATED APPLICATION

This application claims priority to Korean Patent Application No. 10-2020-0172566, filed on Dec. 10, 2020 in the Republic of Korea, the entire contents of which are hereby incorporated by reference for all purposes as if fully set forth herein into the present application.

BACKGROUND

Field

Embodiments of the disclosure relate to a display device and a method for driving the display device.

Description of Related Art

An organic light emitting display device, which has recently been gaining in popularity, presents various advantages, e.g., fast response, luminous efficiency, luminance, and viewing angle, by adopting organic light emitting diodes (OLEDs) that are self-emissive.

The driving transistor in each subpixel of the organic light emitting diode display may degrade as the driving time increases, and thus characteristic values, such as threshold voltage and mobility, may change.

Such time-dependent degradation and resultant changes in characteristic values (e.g., threshold voltage) may also arise in organic light emitting diodes. Since the degree of degradation may differ between the organic light emitting diodes, deviations in characteristic values between the organic light emitting diodes in subpixels may occur.

Accordingly, there is a need for a method for compensating for deviations in characteristic values between driving transistors and a method for compensating for deviations in characteristic values due to degradation of organic light emitting diodes.

BRIEF SUMMARY OF THE DISCLOSURE

According to embodiments of the disclosure, a display device and a method are provided for driving the display device, which may sense a change in the characteristic value of a light emitting device in a subpixel.

According to embodiments of the disclosure, a display device and a method are provide for driving the display device, which may sense the voltage applied to a sensing line in a mono-scan structure to thereby sense the degradation of a light emitting device.

According to embodiments of the disclosure, a display device and a method are provided for driving the display device, which may increase the aperture ratio and save the cost of the data driving circuit.

According to embodiments of the disclosure, a display device can include a display panel including a plurality of data lines, a plurality of gate lines, and a plurality of subpixels including a light emitting device, a data driving circuit driving the plurality of data lines, and a gate driving circuit driving the plurality of gate lines, in which each of the plurality of subpixels includes a driving transistor driving the light emitting device, a switching transistor controlled by a gate signal and controlling a connection between a first node of the driving transistor and a corresponding data line, a sensing transistor controlled by the gate signal and controlling a connection between a second node of the driving transistor and a corresponding sensing line, and a storage capacitor electrically connected between the first node and the second node of the driving transistor, in which the display device further includes a data line switch for switching an electrical connection between a digital-to-analog converter and the data line, a sensing driving switch supplying a sensing driving reference voltage to the second node, an analog-to-digital converter sensing a voltage of the sensing line, and a sampling switch switching an electrical connection between the sensing line and the analog-to-digital converter, in which when the data line switch is in a turn-on state, a sensing driving data voltage is applied to the first node of the driving transistor and, when the data line switch is in an turn-off state, a voltage of the first node of the driving transistor is varied, and when the sensing driving switch is in a turn-on state, the sensing driving reference voltage is applied to the second node of the driving transistor and, when the sensing driving switch is in an turn-off state, a voltage of the second node of the driving transistor is varied, and in a period during which the data line switch and the second switch are in the turn-off state, and the voltage of the first node of the driving transistor increases, the sampling switch is turned on, and the analog-to-digital converter senses the voltage of the sensing line.

According to embodiments of the disclosure, there is provided a method for driving a display device, comprising the display device including a display panel including a plurality of data lines, a plurality of gate lines, and a plurality of subpixels including a light emitting device, a data driving circuit driving the plurality of data lines, and a gate driving circuit driving the plurality of gate lines, in which each of the plurality of subpixels includes a driving transistor driving the light emitting device, a switching transistor controlled by a gate signal and controlling a connection between a first node of the driving transistor and a corresponding data line, a sensing transistor controlled by the gate signal and controlling a connection between a second node of the driving transistor and a corresponding sensing line, and a storage capacitor electrically connected between the first node and the second node of the driving transistor, in which the display device further comprises a data line switch for switching an electrical connection between a digital-to-analog converter and the data line, a sensing driving switch supplying a sensing driving reference voltage to the second node of the driving transistor, an analog-to-digital converter sensing a voltage of the sensing line, and a sampling switch switching an electrical connection between the sensing line and the analog-to-digital converter, wherein when the data line switch is in a turn-on state, a sensing driving data voltage is applied to the first node of the driving transistor and, when the data line switch is in a turn-off state, a voltage of the first node of the driving transistor is varied, in which when the sensing driving switch is in a turn-on state, the sensing driving reference voltage is applied to the second node of the driving transistor and, when the sensing driving switch is in a turn-off state, a voltage of the second node of the driving transistor is varied, and in a period during which the data line switch and the sensing driving switch are in the turn-off state, and the voltage of the first node of the driving transistor increases, the sampling switch is turned on, and the analog-to-digital converter senses the voltage of the sensing line, in which driving the display device includes turning on the data line switch and the sensing driving switch, applying the sensing driving data voltage to the first node of the driving transistor, and applying the sensing driving reference voltage to the second node of the driving transistor, maintaining the data line switch in the turn-on state, turning off the sensing driving switch, applying the sensing driving data voltage to the first node of the driving transistor, and increasing the voltage of the second node of the driving transistor, turning off the data line switch, maintaining the sensing driving switch in the turn-off state, and decreasing the voltages of the first node and the second node of the driving transistor, maintaining the data line switch in the turn-off state, turning on the sensing driving switch, and reapplying the sensing driving reference voltage to the second node of the driving transistor, maintaining the data line switch in the turn-off state, turning off the sensing driving switch, and simultaneously increasing the voltage of the first node and the voltage of the second node of the driving transistor, and turning on the sampling switch and sensing the voltage of the sensing line by the analog-to-digital converter.

According to embodiments of the disclosure, a display device can include a display panel including a plurality of data lines, a plurality of gate lines, and a plurality of subpixels including a light emitting device, a data driving circuit driving the plurality of data lines, and a gate driving circuit driving the plurality of gate lines, in which each of the plurality of subpixels includes a driving transistor driving the light emitting device, a switching transistor controlled by a gate signal and controlling a connection between a first node of the driving transistor and a corresponding data line, a sensing transistor controlled by the gate signal and controlling a connection between a second node of the driving transistor and a corresponding sensing line, and a storage capacitor electrically connected between the first node and the second node of the driving transistor, in which when the data line is in a low impedance state, a sensing driving data voltage is applied to the first node of the driving transistor and, when the data line is in a high impedance state, the voltage of the first node of the driving transistor is varied, in which if an impedance of the data line is a predefined threshold or more, the data line is in the high impedance state and, if the impedance of the data line is less than the threshold, the data line is in the low impedance state, in which when a sensing driving reference voltage is supplied to the sensing line, the sensing driving reference voltage is applied to the second node of the driving transistor and, when the supply of the sensing driving reference voltage to the sensing line is cut off, the voltage of the second node of the driving transistor is varied, and a period during which the data line is in the low impedance state includes a period during which the light emitting device emits light, and a period during which the data line is in the high impedance state includes a period during which the light emitting device does not emit light.

According to embodiments of the disclosure, a display device and a method for driving the display device can sense a change in the characteristic value of a light emitting device in a subpixel.

According to embodiments of the disclosure, a display device and a method for driving the display device can sense the voltage applied to a sensing line in a mono-scan structure to thereby sense the degradation of a light emitting device.

According to embodiments of the disclosure, a display device and a method for driving the display device can increase the aperture ratio and save the cost of the data driving circuit.

BRIEF DESCRIPTION OF THE DRAWINGS

The above and other objects, features, and advantages of the disclosure will be more clearly understood from the following detailed description, taken in conjunction with the accompanying drawings, in which.

DETAILED DESCRIPTION OF THE EMBODIMENTS

Figure 1:
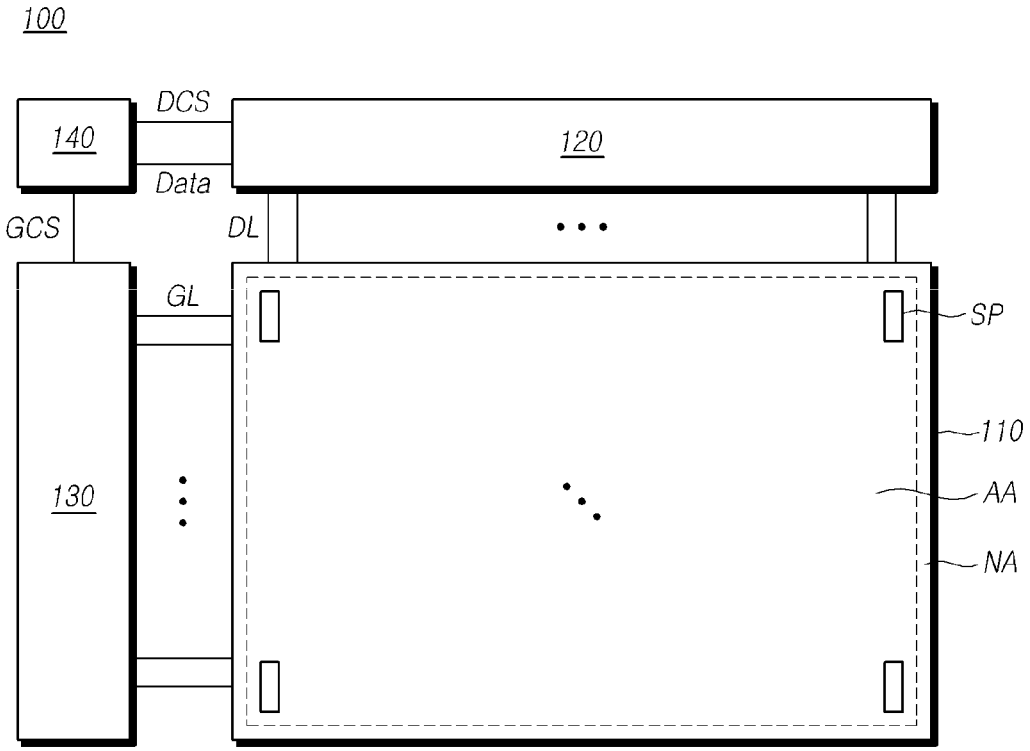
FIG. 1 is a view illustrating a system configuration of a display device according to embodiments of the disclosure.

In the following description of examples or embodiments of the disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the disclosure, detailed descriptions of well-known functions and components incorporated herein will be omitted when it is determined that the description may make the subject matter in some embodiments of the disclosure rather unclear. The terms such as "including," "having," "containing," "constituting" "make up of," and "formed of" used herein are generally intended to allow other components to be added unless the terms are used with the term "only." As used herein, singular forms are intended to include plural forms unless the context clearly indicates otherwise.

Terms, such as "first," "second," "A," "B," "(A)," or "(B)" may be used herein to describe elements of the disclosure. Each of these terms is not used to define essence, order, sequence, or number of elements etc., but is used merely to distinguish the corresponding element from other elements.

When it is mentioned that a first element "is connected or coupled to," "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to," "contact or overlap," etc. each other via a fourth element. Here, the second element may be included in at least one of two or more elements that "are connected or coupled to," "contact or overlap," etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can."

Further, all the components of each display device according to all embodiments of the disclosure are operatively coupled and configured.

FIG. 1 is a view illustrating a system configuration of a display device 100 according to embodiments of the disclosure.

Referring to FIG. 1, according to the embodiments of the disclosure, the display device 100 can include a display panel 110 and driving circuits for driving the display panel 110.

The driving circuits can include a data driving circuit 120 (e.g., data driver) and a gate driving circuit 130 (e.g., gate driver). The display device 100 can further include a controller 140 (e.g., timing controller) controlling the data driving circuit 120 and the gate driving circuit 130.

The display panel 110 can include a substrate and signal lines, such as a plurality of data lines DL and a plurality of gate lines GL disposed on the substrate. The display panel 110 can include a plurality of subpixels SP connected to the plurality of data lines DL and the plurality of gate lines GL.

The display panel 110 can include a display area AA in which images are displayed and a non-display area NA in which no image is displayed. In the display panel 110, a plurality of subpixels SP for displaying images can be disposed in the display area AA, and the driving circuits 120, 130, and 140 can be electrically connected or disposed in the non-display area NA. Further, pad units for connection of integrated circuits or a printed circuit can be disposed in the non-display area NA.

The data driving circuit 120 is a circuit for driving the plurality of data lines DL, and can supply data signals to the plurality of data lines DL. The gate driving circuit 130 is a circuit for driving the plurality of gate lines GL, and can supply gate signals to the plurality of gate lines GL. The controller 140 can supply a data driving timing control signal DCS to the data driving circuit 120 to control the operation timing of the data driving circuit 120. The controller 140 can supply a gate driving timing control signal GCS for controlling the operation timing of the gate driving circuit 130.

The controller 140 can start scanning according to a timing implemented in each frame, convert input image data input from the outside into image data Data suited for the data signal format used in the data driving circuit 120, supply the image data Data to the data driving circuit 120, and control data driving at an appropriate time suited for scanning.

The controller 140 receives, from the outside (e.g., a host system), various timing signals including a vertical synchronization signal, a horizontal synchronization signal, an input data enable signal, and a clock signal, along with the input image data.

To control the data driving circuit 120 and the gate driving circuit 130, the controller 140 receives timing signals, such as the vertical synchronization signal, horizontal synchronization signal, input data enable signal, and clock signal, generates various control signals DCS and GCS, and outputs the control signals to the data driving circuit 120 and the gate driving circuit 130.

As an example, to control the gate driving circuit 130, the controller 140 outputs various gate driving timing control signals GCS including a gate start pulse, a gate shift clock, and a gate output enable signal.

To control the data driving circuit 120, the controller 140 outputs various data driving timing control signals DCS including, e.g., a source start pulse and a source sampling clock.

The controller 140 can be implemented as a separate component from the data driving circuit 120, or the controller 140, along with the data driving circuit 120, can be implemented as an integrated circuit.

The data driving circuit 120 receives the image data Data from the controller 140 and supply data signals to the plurality of data lines DL, thereby driving the plurality of data lines DL. The data driving circuit 120 is also referred to as a 'source driving circuit' or a 'data driver.'

The data driving circuit 120 can include one or more source driver integrated circuit (SDICs).

Each source driver integrated circuit (SDIC) can include a shift register, a latch circuit, a digital-to-analog converter (DAC), and an output buffer. In some situations, each source driver integrated circuit (SDIC) can further include an analog-digital converter (ADC).

For example, each source driver integrated circuit (SDIC) can be connected with the display panel 110 by a tape automated bonding (TAB) method or connected to a bonding pad of the display panel 110 by a chip on glass (COG) or chip on panel (COP) method or can be implemented by a chip on film (COF) method and connected with the display panel 110.

The gate driving circuit 130 can output a gate signal of a turn-on level voltage or a gate signal of a turn-off level voltage according to the control of the controller 140.

The gate driving circuit 130 can sequentially drive the plurality of gate lines GL by sequentially supplying gate signals of the turn-on level voltage to the plurality of gate lines GL.

The gate driving circuit 130 can be connected with the display panel 110 by TAB method or connected to a bonding pad of the display panel 110 by a COG or COP method or can be connected with the display panel 110 according to a COF method. Alternatively, the gate driving circuit 130 can be formed in a gate in panel (GIP) type, in the non-display area NA of the display panel 110. The gate driving circuit 130 can be disposed on the substrate SUB or can be connected to the substrate SUB. In other words, the gate driving circuit 130 that is of a GIP type can be disposed in the non-display area NA of the substrate SUB. The gate driving circuit 130 that is of a chip-on-glass (COG) type or chip-on-film (COF) type can be connected to the substrate SUB.

The data driving circuit 120 can be connected to one side (e.g., an upper or lower side) of the display panel 110. Depending on the driving scheme or the panel design scheme, data driving circuits 120 can be connected with both the sides (e.g., both the upper and lower sides) of the display panel 110, or two or more of the four sides of the display panel 110.

The gate driving circuit 130 can be connected to one side (e.g., a left or right side) of the display panel 110. Depending on the driving scheme or the panel design scheme, gate driving circuits 130 can be connected with both the sides (e.g., both the left and right sides) of the display panel 110, or two or more of the four sides of the display panel 110.

The controller 140 can be a timing controller used in display technology, a control device that can perform other control functions as well as the functions of the timing controller, or a control device other than the timing controller, or can be a circuit in the control device. The controller 140 can be mounted on a printed circuit board or a flexible printed circuit and can be electrically connected with the data driving circuit 120 and the gate driving circuit 130 through the printed circuit board or the flexible printed circuit.

According to embodiments, each of the subpixels SP positioned in the display device 100 can include circuit elements, such as a light emitting device (emitting diode, ED), two or more transistors, and at least one capacitor.

The type and number of circuit elements constituting each subpixel SP can be varied depending on functions to be provided and design schemes.

Figure 2:
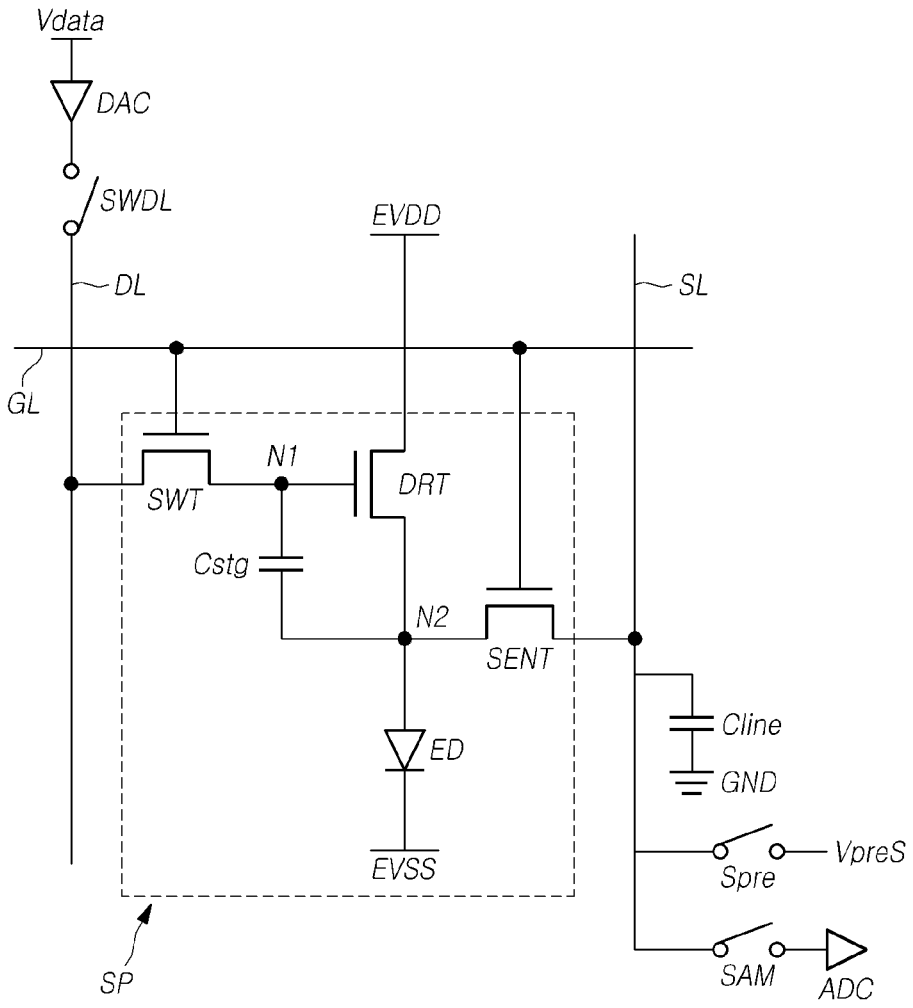
FIG. 2 is a view illustrating an example of a subpixel structure according to embodiments of the disclosure.

FIG. 2 is a view illustrating an example of a subpixel (SP) structure according to embodiments of the disclosure.

Referring to FIG. 2, according to the embodiments of the disclosure, each of the plurality of subpixels SP disposed on the display panel 110 of the display device 100 can include a light emitting device ED, a driving transistor DRT, a switching transistor SWT, a sensing transistor SENT, and a storage capacitor Cstg.

Referring to FIG. 2, according to embodiments of the disclosure, the display device 100 can be a self-emissive display, such as an organic light emitting diode (OLED) display, a quantum dot display, or a micro light emitting diode (LED) display.

According to embodiments of the disclosure, if the display device 100 is an OLED display, each subpixel SP can include an organic light emitting diode (OLED), which by itself emits light, as the light emitting device ED. According to embodiments of the disclosure, if the display device 100 is a quantum dot display, each subpixel SP can include a light emitting device ED formed of a quantum dot which is a semiconductor crystal that emits light on its own. According to embodiments of the disclosure, if the display device 100 is a micro LED display, each subpixel SP can include a micro LED, which is self-emissive and formed of an inorganic material, as the light emitting device ED.

Referring to FIG. 2, the driving transistor DRT is a transistor that supplies a driving current to the light emitting device ED to drive the light emitting device ED, and can be electrically connected between a driving voltage line, which supplies a driving voltage EVDD, and a first electrode of the light emitting device ED.

The driving transistor DRT can include, e.g., a first node N1 and a second node N2.

The first node N1 of the driving transistor DRT can be a gate node of the driving transistor DRT, and can be electrically connected to a source node or a drain node of the switching transistor SWT.

The second node N2 of the driving transistor DRT can be a source node or a drain node of the driving transistor DRT, and can be electrically connected to a source node or a drain node of the sensing transistor SENT.

For example, the first electrode of the light emitting device ED can be connected to the second node N2 (e.g., a source node or a drain node) of the driving transistor DRT, and a base voltage EVSS can be applied to the second electrode of the light emitting device ED.

The switching transistor SWT can be controlled by a scan pulse SCAN, which is a type of gate signal, and can be connected between the first node N1 of the driving transistor DRT and the data line DL. In other words, the switching transistor SWT can be turned on or off according to the scan pulse SCAN supplied from a scan line, which is a type of gate line GL, to control the connection between the data line DL and the first node N1 of the driving transistor DRT.

The switching transistor SWT can be turned on by the scan pulse SCAN having a turn-on level voltage to transmit the data signal Vdata supplied from the data line DL to the first node N1 of the driving transistor.

If the switching transistor SWT is an n-type transistor, the turn-on level voltage of the scan pulse SCAN can be a high-level voltage. If the switching transistor SWT is a p-type transistor, the turn-on level voltage of the scan pulse SCAN can be a low-level voltage.

The storage capacitor Cstg can be electrically connected between the first node N1 and second node N2 of the driving transistor DRT. The storage capacitor Cstg can be charged with an amount of charge corresponding to the voltage difference between two opposite ends thereof, and the corresponding subpixel SP can emit light during a predetermined frame time.

Referring to FIG. 2, according to embodiments of the disclosure, each of the plurality of subpixels SP disposed on the display panel 110 of the display device 100 can further include a sensing transistor SENT.

The sensing transistor SENT can be controlled by a sense pulse SENSE, which is a type of gate signal, and can be connected between the second node N2 of the driving transistor DRT and a reference voltage line for applying a reference voltage, Referring to FIG. 2, the reference voltage line can be a sensing line SL.

Unlike in FIG. 2, the sensing transistor SENT can be turned on or off according to a sense pulse SENSE supplied from a sense line, which is a type of gate line GL, controlling the connection between the sensing line SL and the second node N2 of the driving transistor DRT. In other words, as the first gate line for controlling the switching transistor SWT and the second gate line for controlling the sensing transistor SENT are disposed, two gate lines can be disposed to drive one subpixel SP. Such a structure can be referred to as a dual-scan structure as described below.

The sensing transistor SENT can be turned on by a sense pulse SENSE having a turn-on level voltage, transferring a reference voltage VpreS supplied to the sensing line SL to the second node of the driving transistor DRT.

The sensing transistor SENT can be turned on by the sense pulse SENSE having a turn-on level voltage, transferring the voltage of the second node N2 of the driving transistor DRT to the sensing line SL.

Referring to FIG. 2, according to embodiments of the disclosure, the display device 100 can have a line capacitor Cline formed at the sensing line SL. The line capacitor Cline can be charged with a voltage applied to the sensing line SL.

Referring to FIG. 2, a sensing driving reference voltage VpreS can be applied to the sensing line SL, which can be controlled by a sensing driving switch Spre.

Referring to FIG. 2, the sensing line SL can be connected to a sampling switch SAM for controlling voltage sensing of the sensing line SL. If the sampling switch SAM is turned on, the voltage of the sensing line SL can be applied to an analog-to-digital converter ADC.

If the sensing transistor SENT is an n-type transistor, the turn-on level voltage of the sense pulse SENSE can be a high-level voltage. If the sensing transistor SENT is a p-type transistor, the turn-on level voltage of the sense pulse SENSE can be a low-level voltage.

The function in which the sensing transistor SENT transfers the voltage of the second node N2 of the driving transistor DRT to the sensing line SL can be used upon driving to sense the characteristic value of the subpixel SP. In this situation, the voltage transferred to the sensing line SL can be a voltage for calculating the characteristic value of the subpixel SP or a voltage reflecting the characteristic value of the subpixel SP.

In the disclosure, the characteristic values of the subpixel SP can include the threshold voltage and mobility of the driving transistor DRT, and the threshold voltage of the light emitting device ED.

The driving transistor DRT, the switching transistor SWT, and the sensing transistor SENT can be n-type transistors or p-type transistors. In embodiments of the disclosure, for convenience of description, each of the driving transistor DRT, the switching transistor SWT, and the sensing transistor SENT is an n-type transistor, as an example.

It is possible to use two different gate lines GL to control the switching transistor SWT and the sensing transistor SENT.

In other words, a first gate line can be used to control the switching transistor SWT, and a second gate line can be used to control the sensing transistor SENT. Such a structure can be referred to as a dual-scan structure.

A scan signal SCAN for controlling the switching transistor SWT can be output to the first gate line, and a sense pulse SENSE for controlling the sensing transistor SENT can be output to the second gate line.

In such a dual-scan structure, a constant voltage can be applied to the gate node N1 of the driving transistor DRT to sense the characteristic value of the light emitting device ED, and the source node N2 can be turned into a floating state in which no constant voltage is applied. Since the saturation voltage of the source node N2 varies depending on the degree of degradation of the light emitting device ED, a difference can also occur in the voltage applied to the sensing line SL.

Therefore, the dual-scan structure can adopt a voltage sensing scheme that senses the voltage applied to the sensing line SL to thereby sense the degree of degradation of the light emitting device ED.

However, in this situation, since two gate lines are disposed in one subpixel SP, the area of the aperture through which the light from the light emitting device ED can be emitted to the top surface can be reduced as compared with when one gate line GL is disposed to drive one subpixel SP (e.g., the dual-scan structure requires more wirings which take up more space, which leaves less space available for the light emitting elements).

Referring to FIG. 2, one gate line GL can be disposed to control the switching transistor SWT and the sensing transistor SENT.

In other words, the respective gate nodes of the switching transistor SWT and the sensing transistor SENT can be electrically connected to one gate line GL. Accordingly, both the switching transistor SWT and the sensing transistor SENT can be controlled by the turn-on level voltage and the turn-off level voltage of the gate signal applied to one gate line GL. Such a structure can be referred to as a mono-scan structure.

As compared with the dual-scan structure, the mono-scan structure can increase the area of the aperture as the number of required gate lines GL is reduced. Accordingly, there can be an advantage in terms of luminance.

In such a mono-scan structure, the switching transistor SWT and the sensing transistor SENT are connected to one gate line GL. Thus, if a turn-on level voltage is applied to the gate line GL, the switching transistor SWT and the sensing transistor SENT both can be turned on and, if a turn-off level voltage is applied, the switching transistor SWT and the sensing transistor SENT both can be turned off.

Therefore, in the mono-scan structure, to sense the degree of degradation of the light emitting device ED, it may be limited to apply a constant voltage to the gate node N1 of the driving transistor DRT and to turn the source node N2 into a floating state.

Accordingly, in the mono-scan structure, the saturation voltage of the source node N2 of the driving transistor DRT does not change according to the degree of degradation of the light emitting device ED, and thus the voltage sensing scheme used in the mono-scan structure may be limited. Thus, in the mono-scan structure, the degree of degradation of the light emitting device ED can be determined by measuring the current according to the amount of charge charged to the parasitic capacitor of the light emitting device ED.

The difference in the amount of charge charged to the parasitic capacitor on the degree of degradation of the light emitting device ED is very small. Thus, an integrator capable of converting the difference into a voltage value is additionally disposed. The integrator can be disposed in the data driving circuit 120.

However, if an integrator is additionally disposed in the data driving circuit 120, the cost and size of the data driving circuit 120 can increase.

Accordingly, a need exists for a scheme capable of sensing the threshold voltage of the light emitting device ED while also increasing the area of the aperture.

Figure 3:
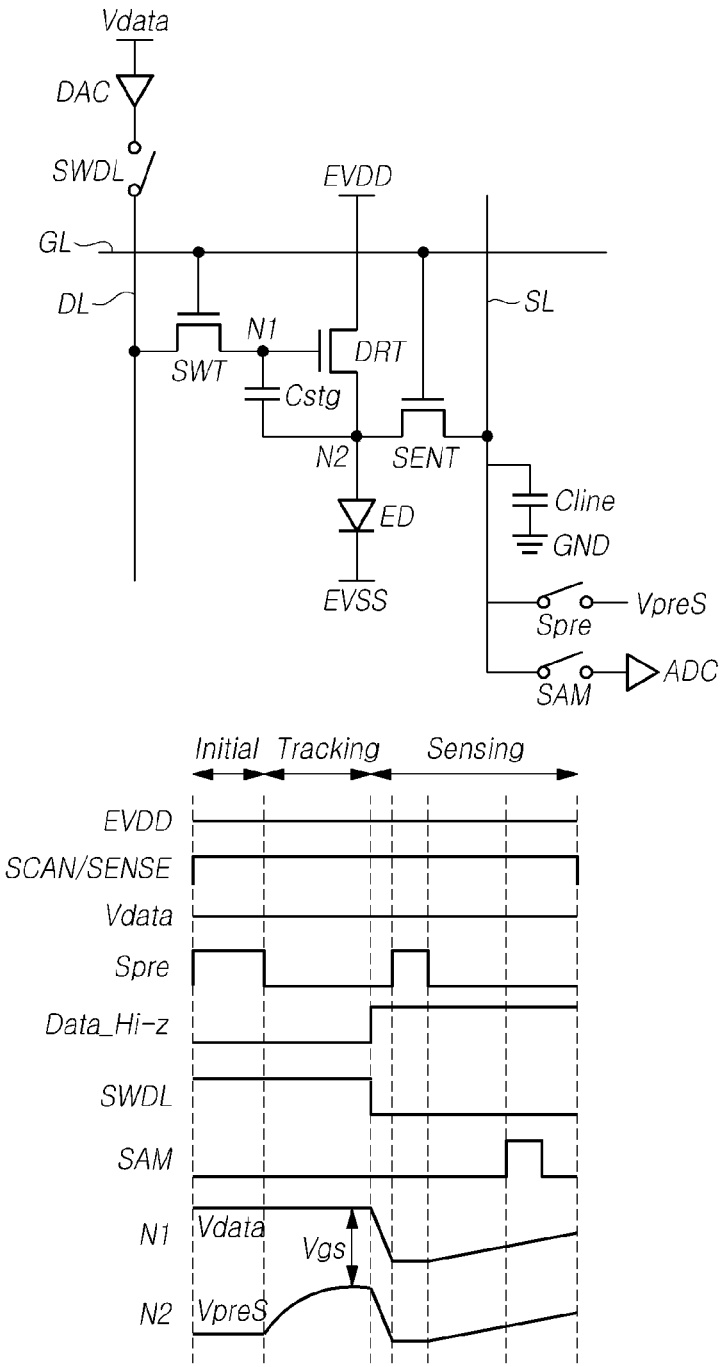
FIG. 3 illustrates an example of a subpixel structure and control signals and voltage waveforms for each period in sensing driving according to embodiments of the disclosure.

FIG. 3 illustrates an example of a subpixel (SP) structure and control signals and voltage waveforms for each period in sensing driving according to embodiments of the disclosure.

Particularly, FIG. 3 illustrates an example subpixel SP structure, a data line switch SWDL can be disposed, which is connected to a data line DL and an output node of data voltage Vdata to control application of the data voltage Vdata to the data line DL. The data line switch SWDL can include one end electrically connected to the data line DL and the other end electrically connected to the digital-to-analog converter DAC.

According to embodiments of the disclosure, the display device 100 can output a switch control signal Data_Hi-z for controlling the turn-on and turn-off of the data line switch SWDL.

Referring to FIG. 3, when the data line switch SWDL is in a turn-on state, the data line switch SWDL can be represented as a high-level state or a low-level state and, when the data line switch SWDL is in a turn-off state, the data line switch SWDL can be represented as a low-level state or a high-level state. Hereinafter, for convenience of description, it is assumed that the data line switch SWDL is in a high-level state when it is a turn-on state and is in a low-level state when it is in a turn-off state.

Referring to FIG. 3, if the data line switch SWDL is turned on, a data voltage for sensing driving can be applied to the data line DL, and the state of the data line DL can be defined as a low impedance state, Since the data line switch SWDL is turned off, the data voltage for sensing driving is not applied to the data line DL, and the state of the data line DL can be defined as a high impedance state.

The low impedance state and the high impedance state of the data line DL can be divided based on a threshold impedance preset for the impedance of the data line DL. For example, if the impedance of the data line DL is smaller than the preset threshold impedance, the data line DL can be referred to as being in a low impedance state and, if the impedance of the data line DL is greater than the threshold impedance, the data line DL can be referred to as being in a high impedance state.

Referring to FIG. 3, if the switch control signal Data_Hi-z is at a low level or a high level, the data line switch SWDL can maintain the turn-on state. When the switch control signal Data_Hi-z is at a high level or a low level, the data line switch SWDL can maintain the turn-off state. For convenience of description, it is assumed below that when the switch control signal Data_Hi-z is at a low level, the data line switch SWDL can be maintained in the turn-on state and, when the switch control signal Data_Hi-z is at a high level, the data line switch SWDL is maintained in the turn-off state.

The switch control signal Data_Hi-z can be a signal output from the controller 140 and applied to the data line switch SWDL. The data line switch SWDL can be turned on or off by the switch control signal Data_Hi-z.

Referring to FIG. 3 illustrating control signals and voltage waveforms for each period in sensing driving, according to embodiments of the disclosure, the sensing driving of the display device 100 can include an initialization period Initial, a tracking period Tracking, and a sensing period Sensing. Further, the sensing period Sensing can be divided into a first sensing period Sensing_1, a second sensing period Sensing_2, a third sensing period Sensing_3, and a fourth sensing period Sensing_4 according to control signals and voltages.

Figure 4:
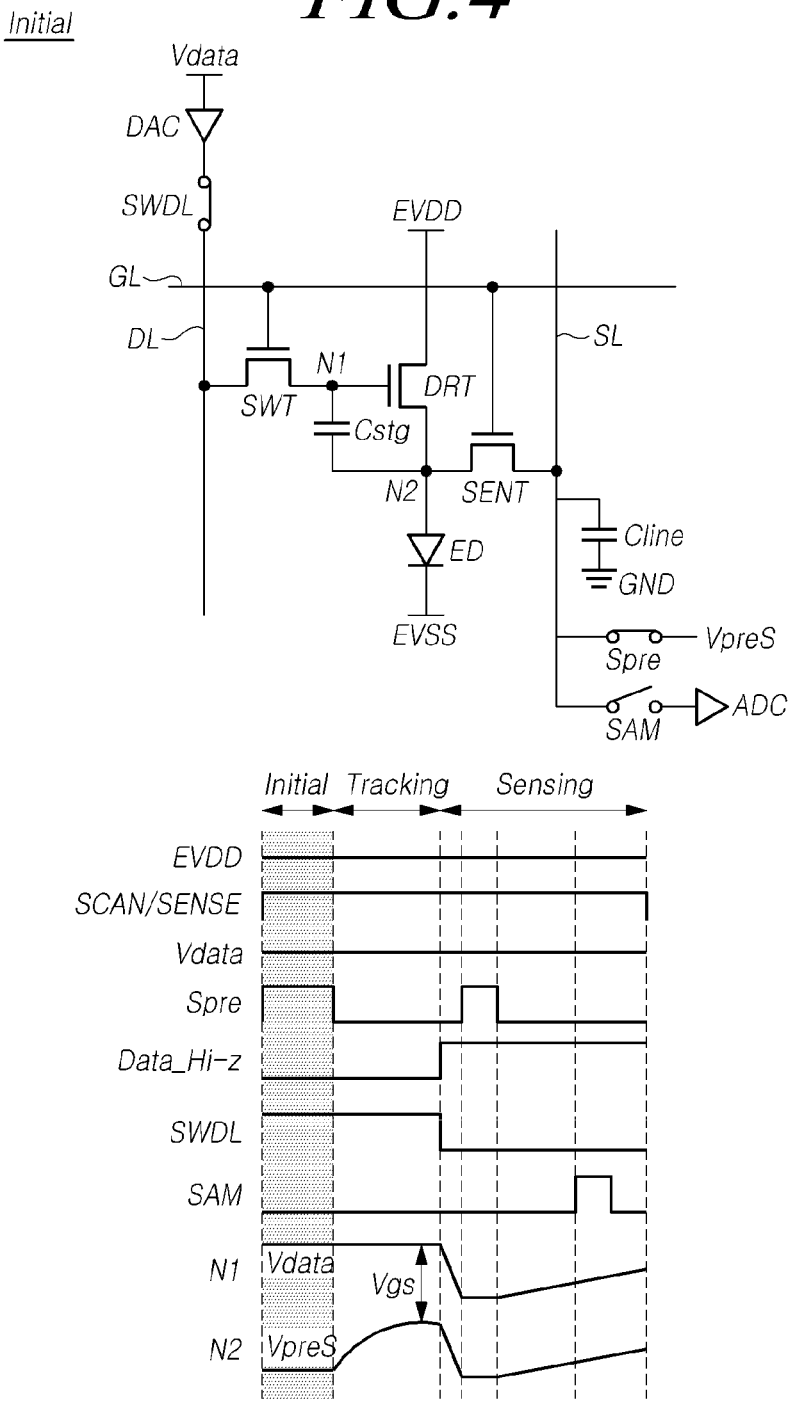
FIG. 4 illustrates an example of a subpixel structure and control signals and voltage waveforms in an initialization period according to embodiments of the disclosure.

FIG. 4 illustrates an example of a subpixel structure and control signals and voltage waveforms in an initialization period Initial according to embodiments of the disclosure.

Referring to FIG. 4, in the initialization period Initial, a driving voltage EVDD can be applied. The switching transistor SWT and the sensing transistor SENT can be connected to the gate line GL, and a gate signal of a turn-on level voltage can be applied to the gate line GL. The data voltage Vdata can be applied as a sensing driving data voltage for sensing during a sensing driving period.

In the initialization period Initial, the sensing driving switch Spre can be turned on, and a sensing driving reference voltage VpreS can be applied to the source node N2 of the driving transistor DRT. The controller 140 can output a low-level switch control signal Data_Hi-z to maintain the data line switch SWDL in the turn-on state. The data line switch SWDL can be turned on to apply a data voltage for sensing driving to the gate node N1 of the driving transistor DRT.

In the initialization period Initial, the sampling switch SAM can be in the turn-off state.

Accordingly, the sensing driving data voltage can be applied, as a constant voltage, to the gate node N1 of the driving transistor DRT, and the sensing driving reference voltage VpreS can be applied, as a constant voltage, to the source node N2.

In the initialization period Initial, the light emitting device ED can be connected with the source node N2 of the driving transistor and the base voltage EVSS, allowing current to flow and emitting light.

In some situations, the starting point of the initialization period Initial can be after the driving of the display device 100 is stopped and the power is turned off, or when the display device 100 is first turned on after being in the powered off state.

Figure 5:
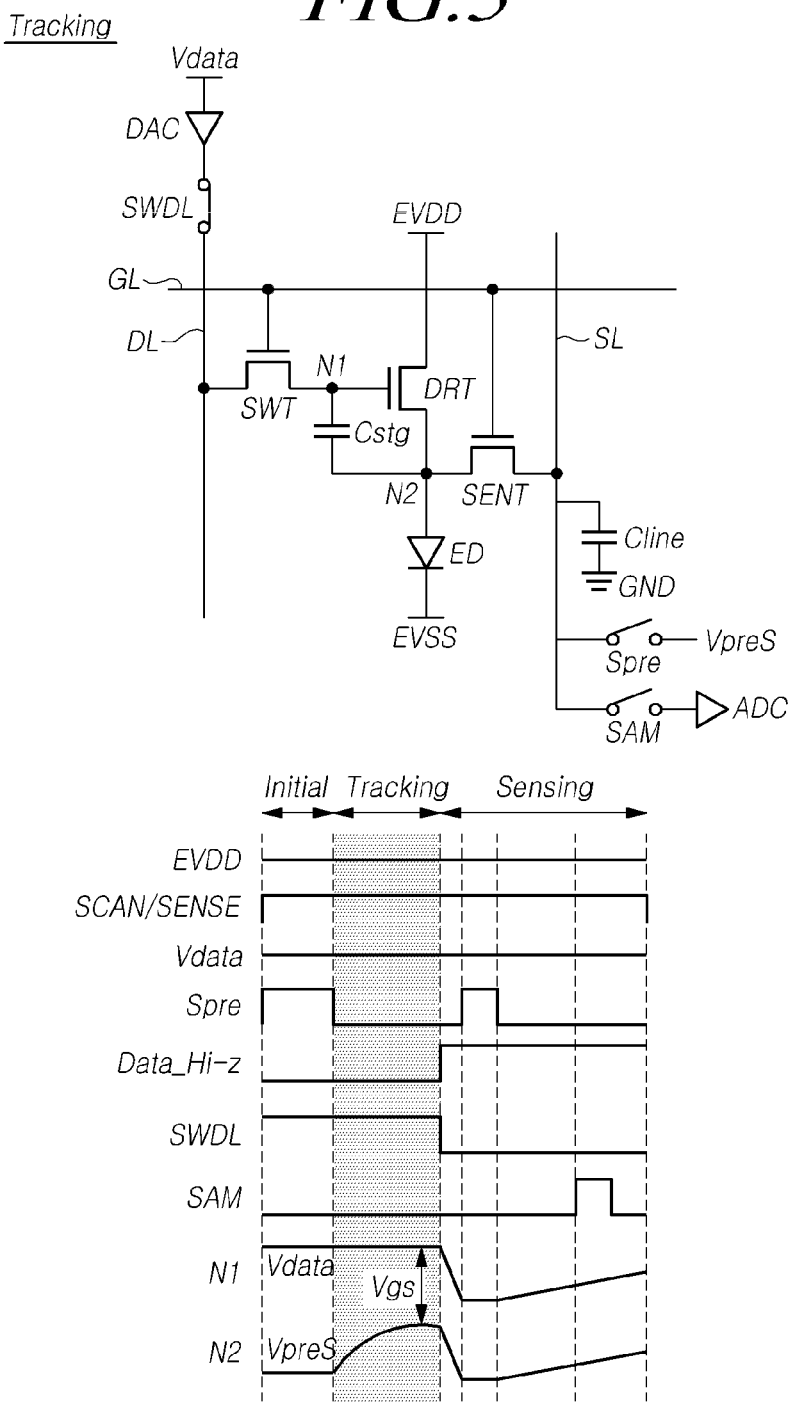
FIG. 5 illustrates an example of a subpixel structure and control signals and voltage waveforms in a tracking period according to embodiments of the disclosure.

FIG. 5 illustrates an example of a subpixel structure and control signals and voltage waveforms in a tracking period Tracking according to embodiments of the disclosure.

Referring to FIG. 5, a driving voltage EVDD can be applied to the driving transistor DRT during a tracking period. A gate signal of a turn-on level voltage can be applied to the switching transistor SWT and the sensing transistor SENT.

The controller 140 can output a low-level switch control signal Data_Hi-z to maintain the data line switch SWDL in the turn-on state. Accordingly, the data line switch SWDL can be maintained in the turn-on state, and a sensing driving data voltage (Vdata) can be applied to the gate node N1 of the driving transistor DRT.

The sensing driving switch Spre can be turned off. Accordingly, the source node N2 of the driving transistor DRT can become a floating state, and the voltage can be varied. The voltage Vs of the source node N2 of the driving transistor DRT can increase as the driving voltage EVDD is applied while the voltage Vg of the gate node N1 remains constant. The voltage Vs of the source node N2 can gradually increase and then stop increasing and, at this time, the voltage Vs of the source node N2 is referred to as being saturated. After the voltage Vs of the source node N2 is saturated, the difference Vgs between the voltage Vg of the gate node N1 of the driving transistor DRT and the voltage Vs of the source node N2 can be maintained at a constant level.

Referring to FIG. 5, the voltage of the source node N2 can be saturated at the time when the tracking period ends.

The saturation voltage when the voltage of the source node N2 is saturated can vary depending on the degree of degradation of the light emitting device ED. Since the threshold voltage of the light emitting device ED increases according to the degree of degradation of the light emitting device ED, as the degradation of the light emitting device ED proceeds, the level of the voltage saturated at the source node N2 of the driving transistor can increase (e.g., a degraded light emitting device ED may need a higher voltage level in order to reach the saturation point).

Charge can be charged to the storage capacitor Cstg by a difference Vgs between the voltage of the gate node N1 and the voltage of the source node N2 of the driving transistor DRT. In the tracking period Tracking, the light emitting device ED can emit light.

Figure 6:
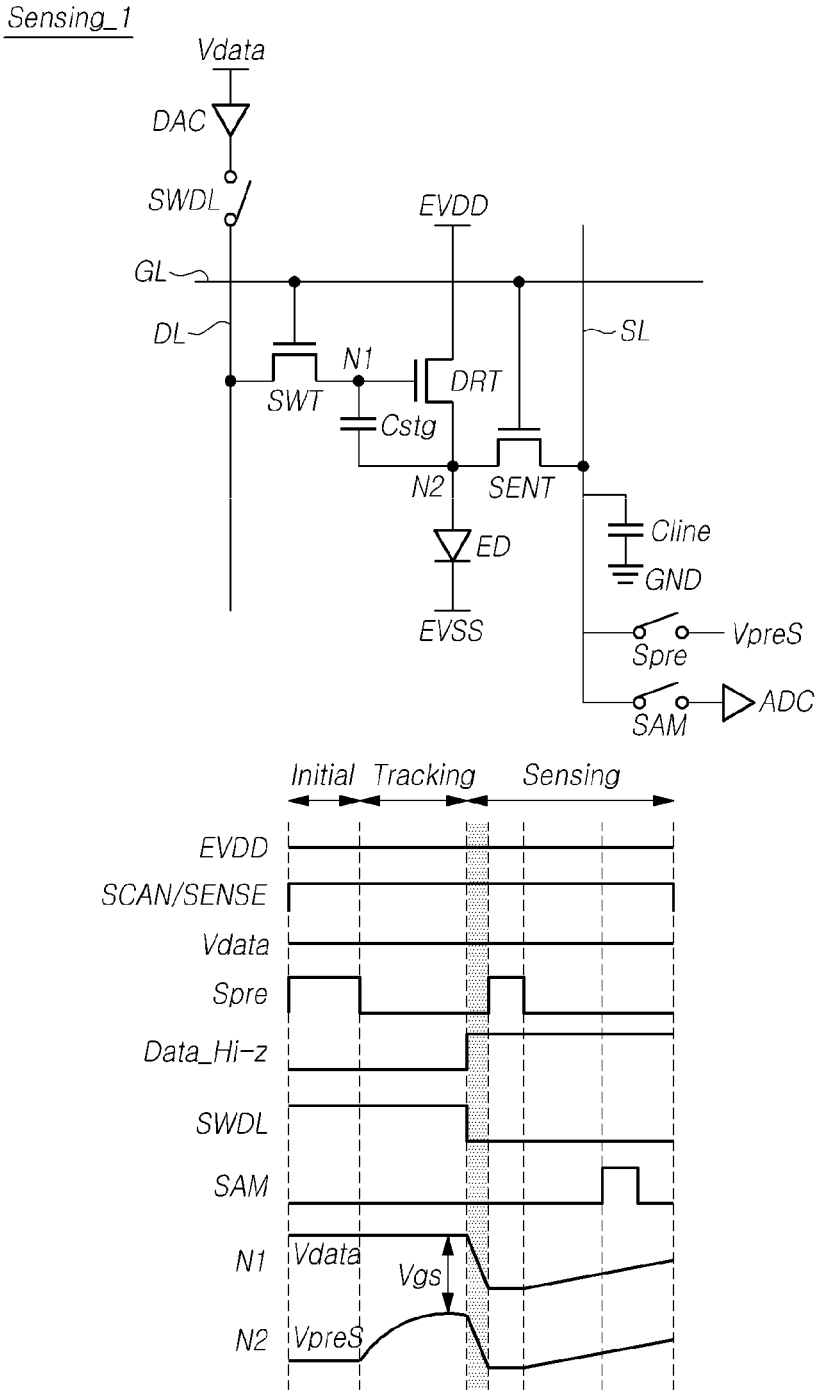
FIG. 6 illustrates an example of a subpixel structure and control signals and voltage waveforms in a first sensing period according to embodiments of the disclosure.

FIG. 6 illustrates an example of a subpixel structure and control signals and voltage waveforms in a first sensing period Sensing_1 according to embodiments of the disclosure (e.g., the first portion of the sensing period).

Referring to FIG. 6, a driving voltage EVDD can be applied to the driving transistor DRT in the first sensing period Sensing_1, and a gate signal of a turn-on level voltage can be applied to the switching transistor SWT and the sensing transistor SENT. The data driving circuit 120 can output a sensing driving data voltage.

Referring to FIG. 6, in the first sensing period Sensing_1, the data line switch SWDL can be turned off. Accordingly, the state of the gate node N1 of the driving transistor DRT can become a floating state, and the voltage of the gate node N1 can be varied. The controller 140 can output a high-level switch control signal Data_Hi-z to maintain the data line switch SWDL in the turn-off state.

In the first sensing period Sensing_1, the sensing driving switch Spre can maintain the turn-off state. Accordingly, the state of the source node N2 of the driving transistor DRT can become a floating state, and the voltage of the source node N2 can be varied.

The gate node N1 of the driving transistor DRT can be connected with the line capacitor Cline of the sensing line SL, so that the voltage Vs of the source node N2 can decrease, and the amount of charge charged to the line capacitor Cline can decrease. The voltage Vg of the gate node N1 electrically coupled to the source node N2 can also decrease.

Figure 7:
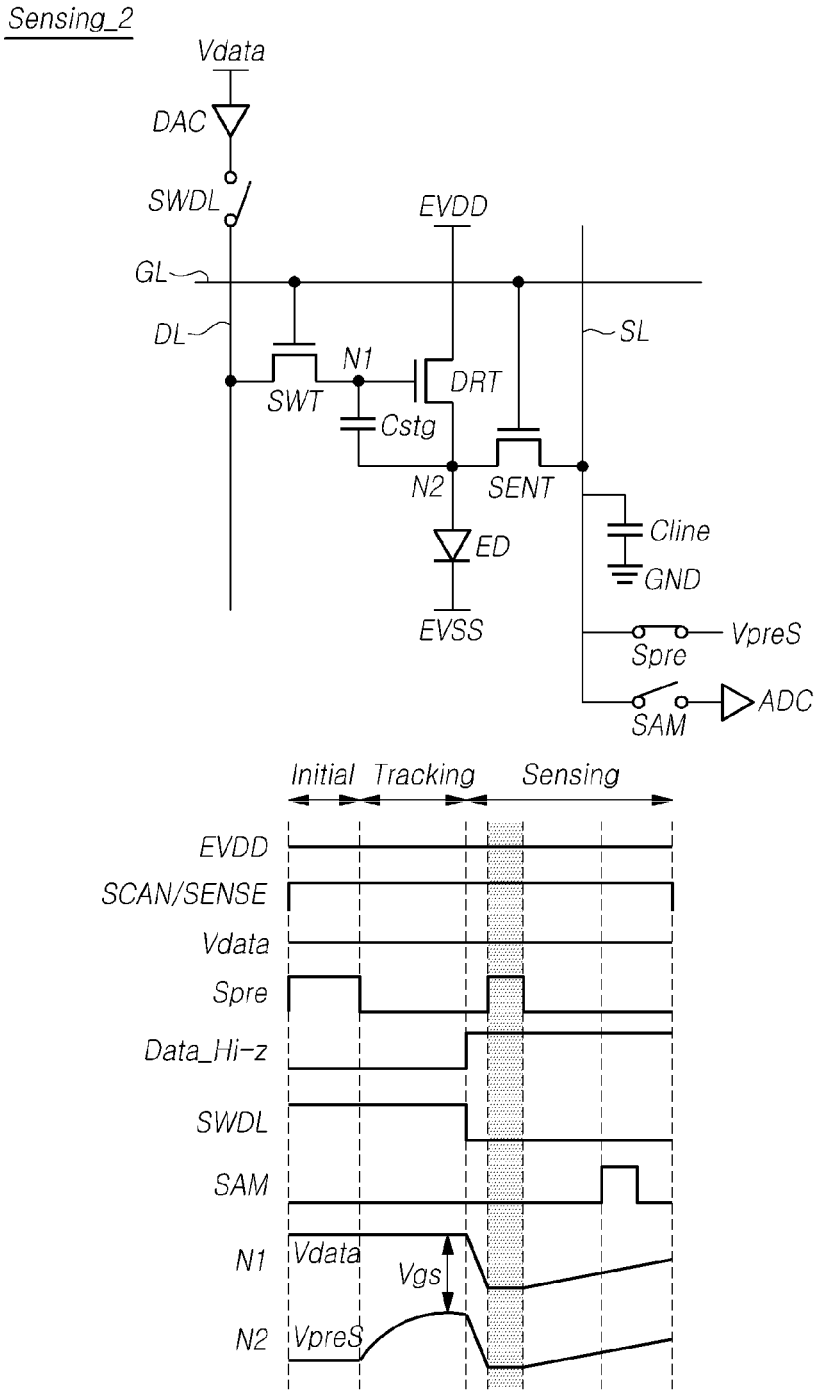
FIG. 7 illustrates an example of a subpixel structure and control signals and voltage waveforms in a second sensing period according to embodiments of the disclosure.

FIG. 7 illustrates an example of a subpixel structure and control signals and voltage waveforms in a second sensing period Sensing_2 according to embodiments of the disclosure.

Referring to FIG. 7, a driving voltage EVDD can be applied to the driving transistor DRT, and a gate signal of a turn-on level voltage can be applied to the switching transistor SWT and the sensing transistor SENT. The data driving circuit 120 can output a sensing driving data voltage.

In the second sensing period Sensing_2, the controller 140 can output a high-level switch control signal Data_Hi-z to maintain the data line switch SWDL in the turn-off state. Accordingly, the turn-off state of the data line switch SWDL can be maintained.

In the second sensing period Sensing_2, the sensing driving switch Spre can be turned on. Accordingly, a sensing driving reference voltage VpreS can be applied to the source node N2 of the driving transistor DRT.

Referring to FIG. 7, the gate node N1 of the driving transistor DRT can be coupled to the source node N2, so that the voltage Vg of the gate node N1 can be constant and make a constant difference from the voltage Vs of the source node N2.

Figure 8:
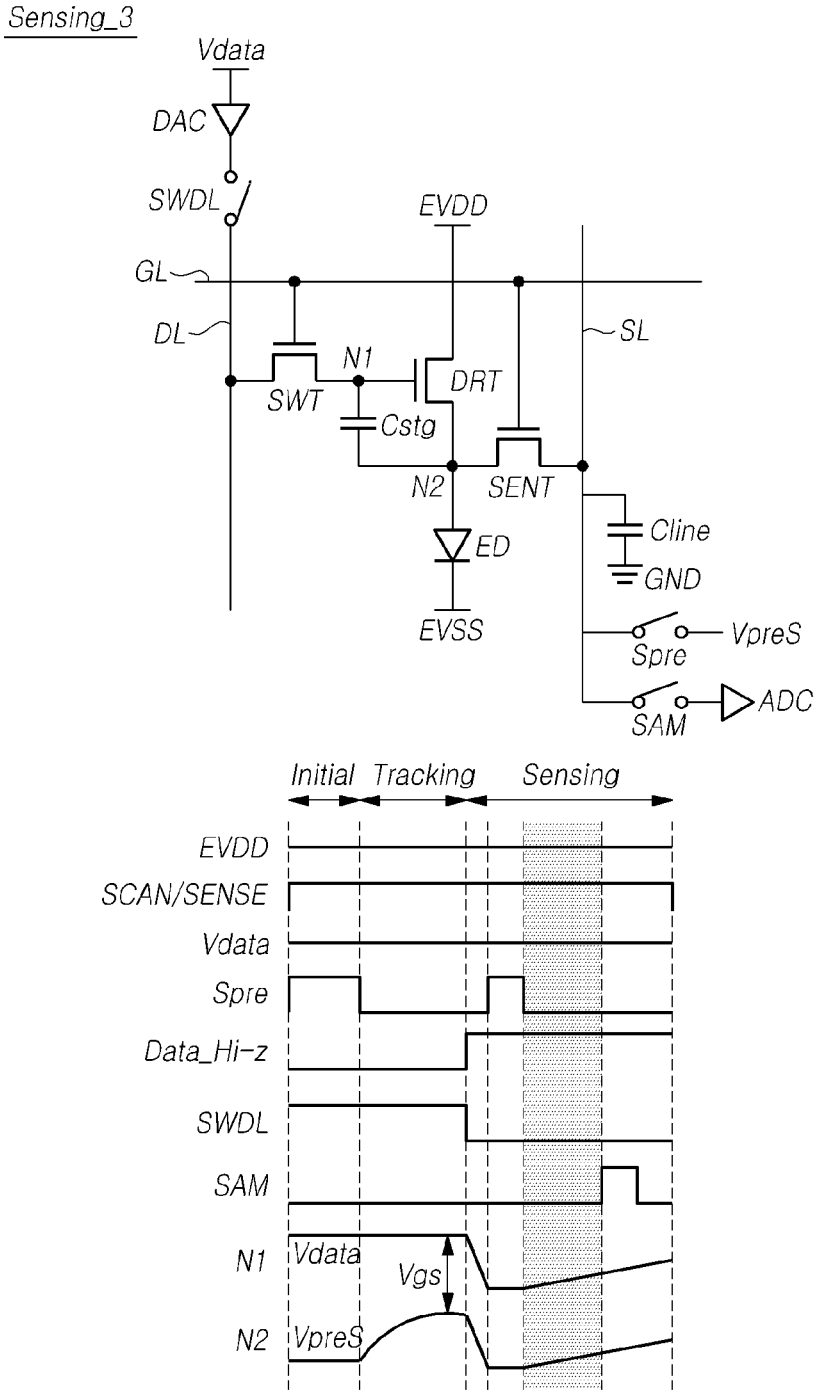
FIG. 8 illustrates an example of a subpixel structure and control signals and voltage waveforms in a third sensing period according to embodiments of the disclosure.

FIG. 8 illustrates an example of a subpixel structure and control signals and voltage waveforms in a third sensing period Sensing_3 according to embodiments of the disclosure.

Referring to FIG. 8, a driving voltage EVDD can be applied to the driving transistor DRT, and a gate signal of a turn-on level voltage can be applied to the switching transistor SWT and the sensing transistor SENT. The data driving circuit 120 can output a sensing driving data voltage.

In the third sensing period Sensing_3, the controller 140 can output a high-level switch control signal Data_Hi-z to maintain the data line switch SWDL in the turn-off state. The turn-off state of the data line switch SWDL can be maintained. Accordingly, the gate node N1 of the driving transistor DRT can be maintained in the floating state, and the voltage of the gate node N1 can be varied.

In the third sensing period Sensing_3, the sensing driving switch Spre can be turned off. Accordingly, the source node N2 of the driving transistor DRT can be placed in a floating state, and the voltage of the source node N2 can be varied.

In the floating state, the voltage of the source node N2 of the driving transistor DRT can increase and, in this situation, the voltage can increase linearly.

The voltage of the gate node N1 coupled to the source node N2 of the driving transistor DRT can also increase as the voltage of the source node N2 increases.

The sensing line SL can be connected to the source node N2 of the driving transistor and, as the voltage of the source node N2 increases, the amount of charge charged to the line capacitor Cline can increase.

Figure 9:
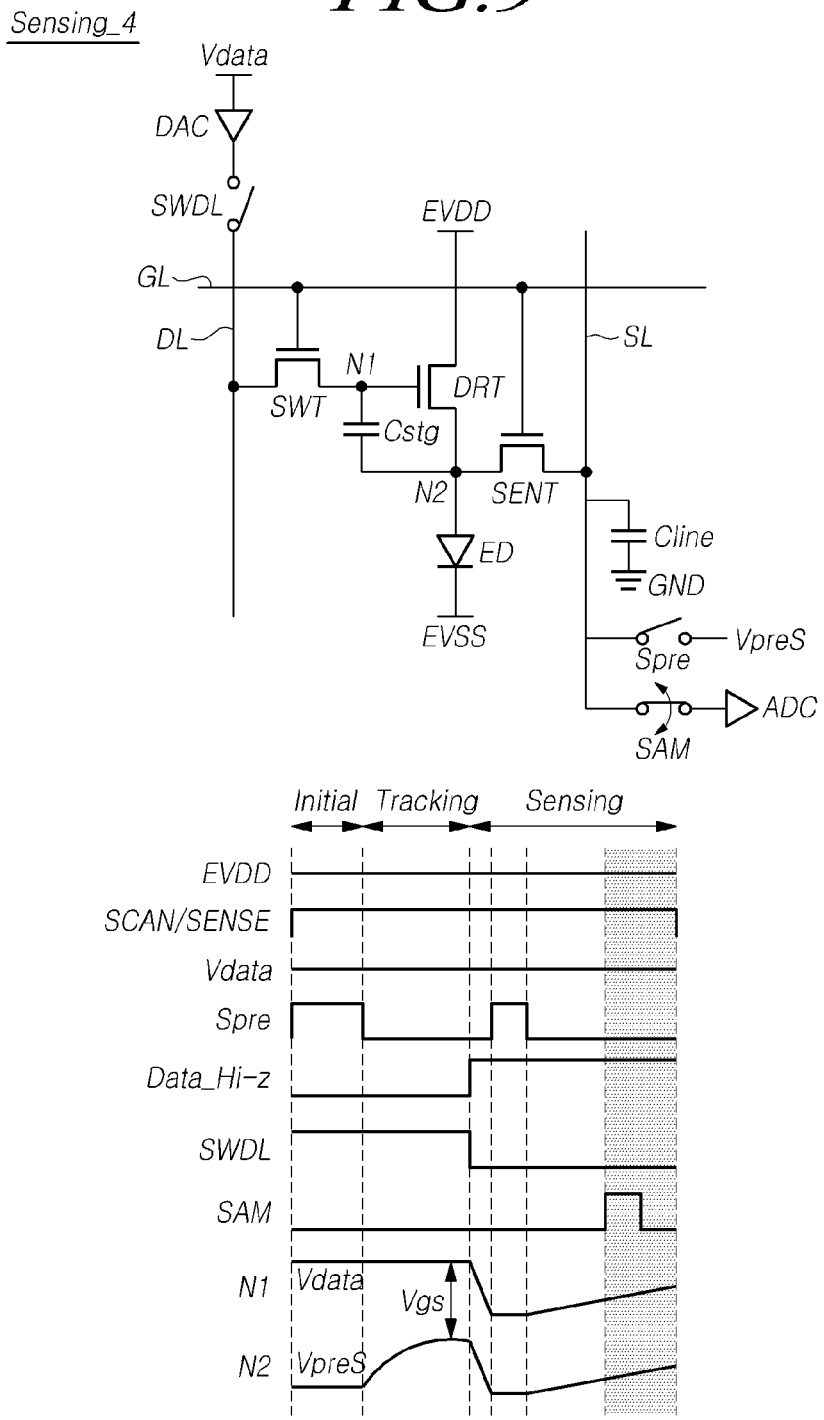
FIG. 9 illustrates an example of a subpixel structure and control signals and voltage waveforms in a fourth sensing period according to embodiments of the disclosure.

FIG. 9 illustrates an example of a subpixel structure and control signals and voltage waveforms in a fourth sensing period Sensing_4 according to embodiments of the disclosure (e.g., the last portion of the sensing period).

Referring to FIG. 9, a driving voltage EVDD can be applied to the driving transistor DRT, and a gate signal of a turn-on level voltage can be applied to the switching transistor SWT and the sensing transistor SENT. The data driving circuit 120 can output a sensing driving data voltage.

In the fourth sensing period Sensing_4, the controller 140 can output a high-level switch control signal Data_Hi-z to maintain the data line switch SWDL in the turn-off state. Accordingly, while in the floating state, the voltage of gate node N1 of the driving transistor DRT can be varied.

In the fourth sensing period Sensing_4, the sensing driving switch Spre can maintain the turn-off state. Accordingly, the source node N2 of the driving transistor DRT can maintain the floating state, and the voltage can be varied.

Referring to FIG. 9, as the sampling switch SAM is turned on, the sampling switch SAM can receive a voltage from the line capacitor Cline and apply the voltage applied to the sensing line SL to the analog-to-digital converter ADC.

The time at which the sampling switch SAM is turned on can vary depending on the design.

Accordingly, the analog-to-digital converter ADC can sense the voltage applied to the sensing line SL. The voltage sensed by the analog-to-digital converter ADC can be a voltage that reflects the degree of degradation of the light emitting device ED.

Accordingly, according to embodiments of the disclosure, it is possible to increase the area of aperture while also being able to sense the degree of degradation of the light emitting device ED by sensing the voltage of the sensing line SL.

Figure 10:
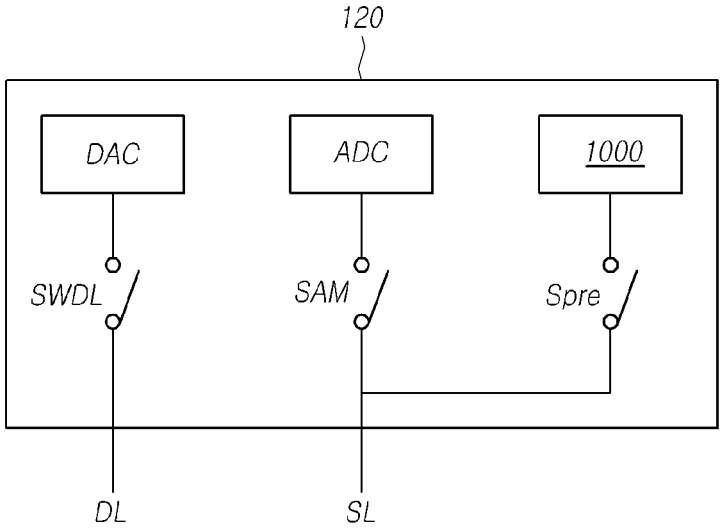
FIG. 10 is a view illustrating an example of a data driving circuit structure according to embodiments of the disclosure.

FIG. 10 is a view illustrating an example of a data driving circuit 120 according to embodiments of the disclosure.

Referring to FIG. 10, according to embodiments of the disclosure, the data driving circuit 120 can include at least one digital-to-analog converter DAC capable of supplying a data voltage Vdata to a data line DL, a reference voltage output unit 1000 capable of supplying a reference voltage VpreS for sensing driving to a sensing line SL, and at least one analog-to-digital converter ADC capable of receiving a voltage of the sensing line SL.

The digital-to-analog converter DAC can be a data voltage output unit including the digital-to-analog converter DAC. The digital-to-analog converter DAC can be electrically connected with the controller 140, receive image data Data from the controller 140, convert the image data Data into a data voltage Vdata, and output the data voltage Vdata to the data line DL. During the initialization period Initial to the fourth sensing period Sensing_4, the controller 140 can output a digital value corresponding to the data voltage for sensing driving to the digital-to-analog converter DAC. The digital-to-analog converter DAC can output the data voltage for sensing driving to the data line DL.

The reference voltage output unit 1000 can convert the digital value input from the controller 140 into a reference voltage VpreS for sensing driving and supply the reference voltage VpreS to the sensing line SL.

According to embodiments of the disclosure, the data driving circuit 120 can include a data line switch SWDL for controlling the output of the data voltage Vdata from the digital-to-analog converter DAC to the data line DL, a sensing driving switch Spre connected between the reference voltage output unit 1000 and the sensing line SL to control the output of the sensing driving reference voltage VpreS, and a sampling switch SAM capable of controlling the supply of voltage from the sensing line SL to the analog-to-digital converter ADC.

Referring to FIGS. 1 and 10, according to embodiments of the disclosure, respective operation timings of the data line switch SWDL, the sampling switch SAM, and the sensing driving switch Spre included in the data driving circuit 120 can be controlled by data driving circuit control signals DCS applied from the controller 140. The signal controlling the switches can be any signal among the data driving timing control signals DCS for controlling the operation timing of the data driving circuit 120.

Accordingly, according to embodiments according to the disclosure, it is possible to figure out the degree of degradation of the light emitting device ED even when using the mono-scan structure for the pixel circuit, thus also saving space. Further, the voltage sensing scheme used in the dual-scan structure can also be adopted to compensate for the degradation of the light emitting device ED.

In other words, according to embodiments of the disclosure, it is possible to sense the degree of degradation of the light emitting device ED and compensate for degradation by using a voltage sensing scheme, not a current sensing scheme, despite adopting a mono-scan structure.

Accordingly, it is possible to sense the degree of degradation of the light emitting device ED without adopting a current sensing scheme using an integrator. Thus, it is possible to save costs and save space allowing for a larger pixel area.

Accordingly, according to embodiments of the disclosure, there can be provided a display device 100 capable of sensing the degree of degradation of the light emitting device ED and compensating for degradation in a mono-scan structure without including an integrator in the data driving circuit 120.

Figure 11:
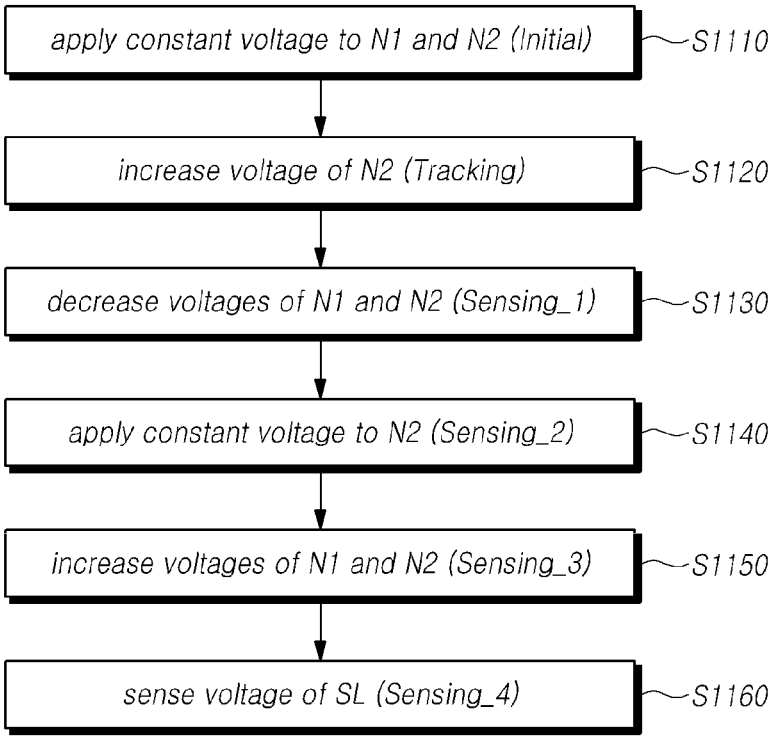
FIG. 11 is a flow chart illustrating sensing driving according to embodiments of the disclosure.

FIG. 11 is a flow chart illustrating sensing driving according to embodiments of the disclosure.

Referring to FIG. 11, according to embodiments of the disclosure, sensing driving can include an initialization (Initial) step S1110, a tracking (Tracking) step S1120, and a sensing (Sensing) step S1130 to S1160. The sensing step can include a first sensing step S1130, a second sensing step S1140, a third sensing step S1150, and a fourth sensing step S1160.

Referring to FIG. 11, in the initialization (Initial) step S1110, the data line switch SWDL can be turned on, and the sensing driving switch Spre can be turned on, so that a constant voltage can be applied to each of the gate node N1 and source node N2 of the driving transistor DRT. The voltage applied to the gate node N1 can be a data voltage for sensing driving. The voltage applied to the source node N2 can be a sensing driving reference voltage VpreS.

In the tracking step S1120, the data line switch SWDL can maintain the turn-on state, and the sensing driving switch Spre can be turned off, so that a constant voltage can be applied to the gate node N1 of the driving transistor DRT, and the voltage of the source node N2 can be varied. The voltage Vs of the source node N2 of the driving transistor DRT can gradually increase. In this situation, the voltage Vs of the source node N2 can be saturated at a different voltage depending on the degree of degradation of the light emitting device ED. For example, if the light emitting device ED is further degraded, the voltage of the source node N2 of the driving transistor DRT can be saturated at a higher voltage.

In the first sensing step S1130, the data line switch SWDL can be turned off, the sensing driving switch Spre can maintain the turn-off state, and the voltage Vs of the source node N2 of the driving transistor DRT can decrease. Thus, the voltage of the gate node N1 electrically coupled to the source node N2 can also decrease.

In the second sensing step S1140, the data line switch SWDL can maintain the turn-off state, the sensing driving switch Spre can be turned on, and the sensing driving reference voltage VpreS can be applied to the source node N2 of the driving transistor DRT. Accordingly, the voltage Vs of the source node N2 can have a constant value, and the voltage of the gate node N1 electrically coupled to the source node N2 can also have a constant value.

In the third sensing step S1150, the data line switch SWDL can maintain the turn-off state, the sensing driving switch Spre can be turned off, and the voltage Vs of the source node N2 of the driving transistor DRT can increase. The voltage of the gate node N1 coupled to the source node N2 can also increase. As the voltage of the source node N2 increases, the voltage applied to the sensing line SL electrically connected with the source node N2 can also increase.

In the fourth sensing step S1160, the data line switch SWDL can maintain the turn-off state, the sensing driving switch Spre can maintain the turn-off state, and the sampling switch SAM can be turned on, so that the voltage of the sensing line SL can be applied to the analog-to-digital converter ADC.

Accordingly, according to embodiments of the disclosure, there can be provided a display device 100 using a data driving circuit 120 with a reduced cost and increased aperture (e.g., allowing for more display area).

Figure 12:
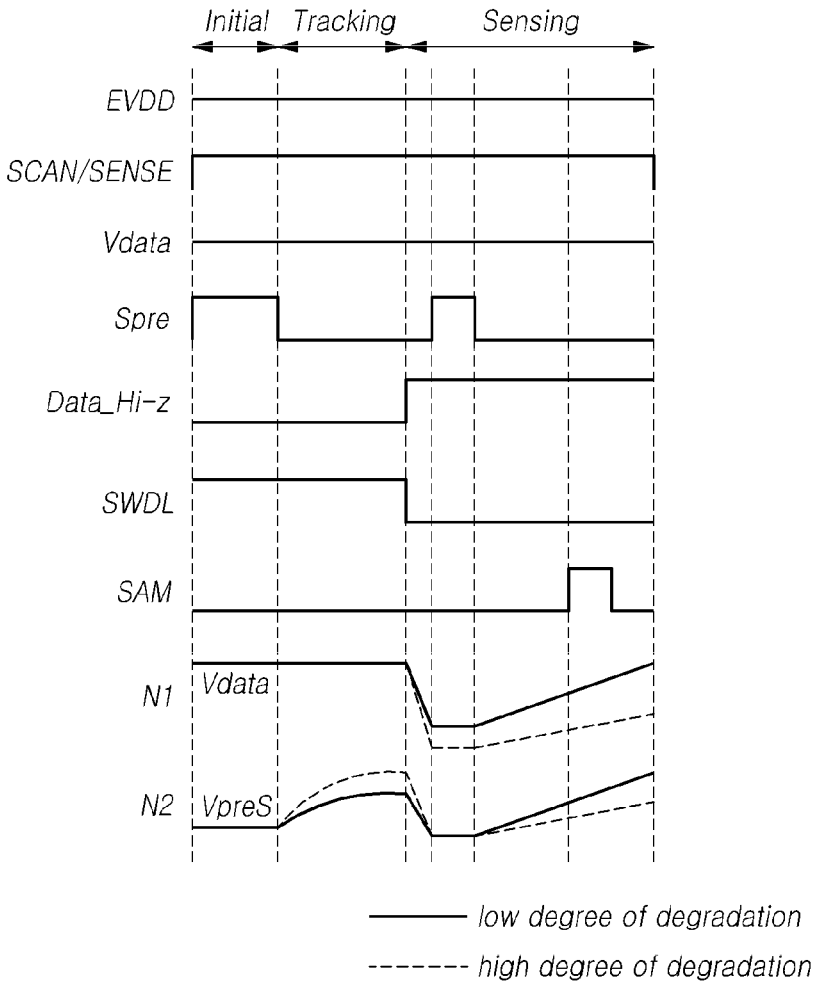
FIG. 12 is a view illustrating control signals and voltage waveforms for each period for sensing the degree of degradation of an organic light emitting diode according to embodiments of the disclosure.

FIG. 12 is a view illustrating control signals and voltage waveforms for each period for sensing the degree of degradation of a light emitting device ED according to embodiments of the disclosure.

Referring to FIGS. 3 and 12, the light emitting device ED emits light according to a voltage difference between the gate node N1 and the source node N2 of the driving transistor DRT. In an equivalent circuit, the driving transistor DRT and the light emitting device ED each can be presented as a resistance component. The voltage Vs of the source node N2 of the driving transistor DRT can be determined in accordance with the voltage division rule between the first resistance component R1 of the driving transistor DRT and the second resistance component R2 of the light emitting device ED.

If the light emitting device ED is degraded, the resistance component of the light emitting device ED increases. Therefore, in view of an equivalent circuit, it can be said that the resistance component of the light emitting device ED, i.e., the second resistance R2, increases. Since the current Ids between the drain node and the source node of the driving transistor DRT decreases due to the degradation of the light emitting device ED, the voltage difference between the gate node N1 and the source node N2 of the driving transistor DRT reduces as compared with before degradation. As shown in FIG. 12, the degree to which the voltage Vg of the gate node N1 is lowered may vary depending on the degree of degradation of the light emitting device ED.

Accordingly, the amount of charge stored in the line capacitor Cline of the sensing line SL is also varied depending on the degree of degradation of the light emitting device ED. For example, if the light emitting device ED is further degraded, the amount of charge stored in the line capacitor Cline further reduces. The slope of the amount of charge charged to the line capacitor Cline according to the degree of degradation per unit time can decrease as the degree of degradation of the light emitting device ED increases.

Therefore, even when the sampling switch SAM is turned on at a predetermined time interval from the time when the sensing driving switch Spre is turned off, the magnitude of the voltage applied to the sensing line SL can be varied depending on the degree of degradation of the light emitting device ED. Accordingly, the value of the voltage applied to the analog-to-digital converter ADC can vary.

In other words, the voltage sensed by the analog-to-digital converter ADC can be a voltage value reflecting the degree of degradation of the light emitting device ED. For example, the voltage value sensed by the analog-to-digital converter ADC can decrease as the degradation of the light emitting device ED increases.

According to embodiments of the disclosure, the analog-to-digital converter ADC included in the display device 100 can convert the voltage of the sensing line SL into a digital value and transmit sensing data (sensing value), which is the converted digital value, to the controller 140.

The controller 140 can receive the sensing data, determine the degree of degradation of the light emitting device ED based on the sensing data, calculate a compensation value for compensating for the degradation deviation between light emitting devices ED based thereupon, and store the compensation value in a memory.

The controller 140 can change the image data Data to be supplied to the corresponding subpixel SP based on the compensation value stored in the memory and supply it to the data driving circuit 120. Accordingly, the data driving circuit 120 can convert the changed image data Data' into a data voltage Vdata' in the form of an analog voltage and output it to the corresponding data line DL. Accordingly, compensation for the degradation of the light emitting device ED in the corresponding subpixel SP can be actually performed.

The degradation of the light emitting device ED can mean the threshold voltage of the light emitting device ED, and the degradation deviation between light emitting devices ED can mean the threshold voltage deviation between the light emitting devices ED.

Accordingly, according to embodiments of the disclosure, the display device 100 can compensate for the characteristic values of the light emitting device ED without having to additionally include an integrator in the data driving circuit 120 for a mono-scan structure. Accordingly, it is possible to provide a display device 100 that can reduce manufacturing costs of the data driving circuit 120 and implement a high luminance with an increased aperture.

Further, according to embodiments of the disclosure, the display device 100 can compensate for degradation of the light emitting device ED, thereby mitigating ghosting that can arise in long term use of the display device 100.

The above description has been presented to enable any person skilled in the art to make and use the technical idea of the disclosure, and has been provided in the context of a particular application and its requirements. Various modifications, additions and substitutions to the described embodiments will be readily apparent to those skilled in the art, and the general principles defined herein can be applied to other embodiments and applications without departing from the spirit and scope of the disclosure. The above description and the accompanying drawings provide an example of the technical idea of the disclosure for illustrative purposes only. That is, the disclosed embodiments are intended to illustrate the scope of the technical idea of the disclosure.

Thus, the scope of the disclosure is not limited to the embodiments shown, but is to be accorded the widest scope consistent with the claims. The scope of protection of the disclosure should be construed based on the following claims, and all technical ideas within the scope of equivalents thereof should be construed as being included within the scope of the disclosure.

What is claimed is:

1. A display device, comprising:

a display panel including a plurality of data lines, a plurality of gate lines, and a plurality of subpixels;

a data driving circuit configured to drive the plurality of data lines; and a gate driving circuit configured to drive the plurality of gate lines, wherein each of the plurality of subpixels includes:

a light emitting device;

a driving transistor configured to drive the light emitting device;

a switching transistor configured to receive a gate signal and control a connection between a first node of the driving transistor and a corresponding data line;

a sensing transistor configured to receive the gate signal and control a connection between a second node of the driving transistor and a sensing line; and a storage capacitor electrically connected between the first node and the second node of the driving transistor, wherein the display device further comprises:

a data line switch configured to switch an electrical connection between a digital-to-analog converter and the data line;

a sensing driving switch configured to supply a sensing driving reference voltage to the second node;

an analog-to-digital converter configured to sense a voltage of the sensing line; and a sampling switch configured to switch an electrical connection between the sensing line and the analog-to-digital converter, wherein when the data line switch is in a turn-on state, a sensing driving data voltage is applied to the first node of the driving transistor, and when the data line switch is in a turn-off state, a voltage of the first node of the driving transistor is varied, wherein when the sensing driving switch is in a turn-on state, the sensing driving reference voltage is applied to the second node of the driving transistor, and when the sensing driving switch is in a turn-off state, a voltage of the second node of the driving transistor is varied, and wherein in a period during which the data line switch and the sensing driving switch are in the turn-off state and the voltage of the first node of the driving transistor increases, the sampling switch is turned on and the analog-to-digital converter senses the voltage of the sensing line.

2. The display device of claim 1, wherein a gate of the switching transistor and a gate of the sensing transistor are both connected to a same gate line among the plurality of gate lines.

3. The display device of claim 1, wherein during a first period, the data line switch and the sensing driving switch are turned on, and the sensing driving data voltage is applied to the first node of the driving transistor, and the sensing driving reference voltage is applied to the second node of the driving transistor.

4. The display device of claim 3, wherein during a second period after the first period, the data line switch maintains the turn-on state, and the sensing driving switch is turned off, and the sensing driving data voltage is applied to the first node of the driving transistor, and the voltage of the second node of the driving transistor increases.

5. The display device of claim 4, wherein during a third period after the second period, the data line switch is turned off, the sensing driving switch maintains the turn-off state, and the voltage of the first node and the voltage of the second node of the driving transistor both simultaneously decrease, wherein during a fourth period after the third period, the data line switch maintains the turn-off state, the sensing driving switch is turned on, the sensing driving reference voltage is reapplied to the second node of the driving transistor, and the voltage of the first node of the driving transistor has a constant value, and wherein during a fifth period after the fourth period, the data line switch maintains the turn-off state, the sensing driving switch is turned off, and the voltage of the first node and the voltage of the second node of the driving transistor both simultaneously increase.

6. The display device of claim 5, wherein during a sixth period after the fifth period, the sampling switch is turned on, and the analog-to-digital converter senses the voltage of the sensing line.

7. The display device of claim 6, wherein the first period corresponds to an initialization period for a subpixel, the second period corresponds to an tracking period for the subpixel, the third period corresponds to a first portion of a sensing period for the subpixel, the fourth period corresponds to a second portion of the sensing period for the subpixel, the fifth period corresponds to a third portion of the sensing period for the subpixel, and the sixth period corresponds to a fourth portion of the sensing period for the subpixel.

8. The display device of claim 1, wherein in a period from a time when a gate signal of a turn-on level voltage is applied to both the switching transistor and the sensing transistor to a time before a gate signal of a turn-off level voltage is applied to both the switching transistor and the sensing transistor, the sensing driving data voltage is applied to the first node of the driving transistor, or the voltage of the first node is varied, and the sensing driving reference voltage is applied to the second node of the driving transistor, or the voltage of the second node is varied.

9. The display device of claim 1, further comprising a line capacitor electrically connected with the sensing line, wherein the line capacitor is charged in a period during which the sensing driving reference voltage is not applied to the second node of the driving transistor, and the data line switch and the sensing driving switch are both in the turn-off state.

10. A method for driving a display device, the method comprising:

controlling, by the display device, a data line switch to be in a turn-on state, the data line switch being connected between a digital-to-analog converter and a data line of a subpixel included in the display device;

when the data line switch is in the turn-on state, applying a sensing driving data voltage to a gate of a driving transistor of the subpixel, the gate of the driving transistor being connected to a switching transistor controlled by a gate signal;

controlling the data line switch to be in a turn-off state;

when the data line switch is in the turn-off state, varying a voltage of the gate of the driving transistor;

sensing a voltage of a sensing line of the subpixel by an analog-to-digital converter, in a period during which a sampling switch connected to the sensing line is in the turned on state, the data line switch and a sensing driving switch connected to the sensing line are both in the turn-off state and the voltage of the gate of the driving transistor increases, wherein a sensing transistor is connected between the sensing line and the driving transistor.

11. The method of claim 10, wherein a gate of the switching transistor and a gate of the sensing transistor are connected to a same gate line.

12. The method of claim 10, further comprising:

turning on the data line switch and the sensing driving switch, applying the sensing driving data voltage to the gate of the driving transistor, and applying a sensing driving reference voltage to a source or drain of the driving transistor;

maintaining the data line switch in the turn-on state, turning off the sensing driving switch, applying the sensing driving data voltage to the gate of the driving transistor, and increasing the voltage of the gate of the driving transistor;

turning off the data line switch, maintaining the sensing driving switch in the turn-off state, and decreasing the voltage of the gate of the driving transistor;

maintaining the data line switch in the turn-off state, turning on the sensing driving switch, and reapplying the sensing driving reference voltage to the source or drain of the driving transistor;

maintaining the data line switch in the turn-off state, turning off the sensing driving switch, and simultaneously increasing the voltage of the gate of the driving transistor and a voltage of the source or drain of the driving transistor; and turning on the sampling switch and sensing the voltage of the sensing line by the analog-to-digital converter.

13. The method of claim 10, wherein in a period during which a gate signal of a turn-on level voltage is applied to the switching transistor and the sensing transistor, the sampling switch is turned on, and the analog-to-digital converter senses the voltage of the sensing line.

14. The method of claim 10, further comprising:

charging a line capacitor connected with the sensing line in a period during which a sensing driving reference voltage is applied to the driving transistor, and the data line switch and the sensing driving switch are both in the turn-off state.

15. A display device, comprising:

a display panel including a plurality of data lines, a plurality of gate lines, and a plurality of subpixels;

a data driving circuit configured to drive the plurality of data lines; and a gate driving circuit configured to drive the plurality of gate lines, wherein at least one subpixel among the plurality of subpixels includes:

a light emitting device;

a driving transistor configured to drive the light emitting device;

a switching transistor configured to receive a gate signal and control a connection between a first node of the driving transistor and a corresponding data line;

a sensing transistor configured to receive the gate signal and control a connection between a second node of the driving transistor and a sensing line; and a storage capacitor electrically connected between the first node and the second node of the driving transistor, wherein when the corresponding data line is in a low impedance state, a sensing driving data voltage is applied to the first node of the driving transistor, and when the corresponding data line is in a high impedance state, the voltage of the first node of the driving transistor is varied, wherein when an impedance of the corresponding data line is a predefined threshold or more, the data line is in the high impedance state, and when the impedance of the corresponding data line is less than the threshold, the data line is in the low impedance state, wherein when a sensing driving reference voltage is supplied to the sensing line, the sensing driving reference voltage is applied to the second node of the driving transistor, and when the supply of the sensing driving reference voltage to the sensing line is cut off, the voltage of the second node of the driving transistor is varied, and wherein a period during which the corresponding data line is in the low impedance state includes the light emitting device emitting light, and a period during which the corresponding data line is in the high impedance state includes light emitting device in an off state that does not emit light.

16. The display device of claim 15, wherein a gate of the switching transistor and a gate of the sensing transistor are both connected to a same gate line among the plurality of gate lines.

17. The display device of claim 15, wherein the data driving circuit includes:

at least one digital-to-analog converter configured to output a data voltage to the data line;

a reference voltage generator configured to output the sensing driving reference voltage to the sensing line;

at least one analog-to-digital converter connected with the sensing line to sense the voltage of the sensing line;

a data line switch configured to switch an electrical connection between the digital-to-analog converter and the data line;

a sensing driving switch connected with a sensing driving reference voltage output node of the reference voltage output generator to control the output of the sensing driving reference voltage; and a sampling switch connected with a voltage input node of the analog-to-digital converter and configured to switch an electrical connection between the sensing line and the analog-to-digital converter.

18. The display device of claim 17, wherein a period during which the display device is driven includes:

a first period during which the data line switch is turned on and the sensing driving data voltage is output to a data line electrically connected with the data line switch, and the sensing driving switch is turned on and the sensing driving reference voltage is output to a sensing line electrically connected with the sensing driving switch;

a second period during which, after the first period, the data line switch maintains the turn-on state, the sensing driving data voltage is output to the data line, and the sensing driving switch is turned off;

a third period during which, after the second period, the data line switch is turned off, and the sensing driving switch maintains the turn-off state;

a fourth period during which, after the third period, the data line switch maintains the turn-off state, and the sensing driving switch is turned on and the sensing driving reference voltage is output to the sensing line;

a fifth period during which, after the fourth period, the data line switch maintains the turn-off state, and the sensing driving switch maintains the turn-off state; and a sixth period during which, after the fifth period, the sampling switch is turned on, and the analog-to-digital converter receives the voltage of the sensing line.

19. The display device of claim 18, wherein the first period corresponds to an initialization period for the at least one subpixel, the second period corresponds to a tracking period for the at least one subpixel, the third period corresponds to a first portion of a sensing period for the at least one subpixel, the fourth period corresponds to a second portion of the sensing period for the at least one at least one subpixel, the fifth period corresponds to a third portion of the sensing period for the subpixel, and the sixth period corresponds to a fourth portion of the sensing period for the at least one subpixel.

20. The display device of claim 15, wherein the data driving circuit is electrically connected with a controller controlling the data line switch, the sensing driving switch, and the sampling switch, and wherein a timing when the data line switch, the sensing driving switch, and the sampling switch are turned on or off is controlled by a control signal output from the controller.

* * * * *